US006675868B2

(12) United States Patent
Dodd

(10) Patent No.: US 6,675,868 B2
(45) Date of Patent: Jan. 13, 2004

(54) APPARATUS FOR PERFORMING FOUNDRY WORK

(76) Inventor: Alec G Dodd, 24 Newbridge Road, Ambergate, Derbyshire, DE56 2GR (GB)

( * ) Notice: Subject to any disclaimer, the term of this patent is extended or adjusted under 35 U.S.C. 154(b) by 45 days.

(21) Appl. No.: 10/151,945

(22) Filed: May 22, 2002

(65) Prior Publication Data

US 2002/0129916 A1 Sep. 19, 2002

Related U.S. Application Data

(62) Division of application No. 09/978,028, filed on Oct. 17, 2001, now abandoned.

(30) Foreign Application Priority Data

Nov. 2, 2000 (GB) ..... 0026752

(51) Int. Cl.[7] ..... B22C 19/00; B22C 9/04

(52) U.S. Cl. ..... 164/412; 164/516; 164/35; 164/45; 164/165; 164/235

(58) Field of Search ..... 164/516, 35, 30, 164/340, 369, 397, 398, 399, 412, 45, 235, 165

(56) References Cited

U.S. PATENT DOCUMENTS 1,563,480 A * 12/1925 Gibson ..... 164/399
4,474,224 A * 10/1984 Higginbotham et al. . 164/151.2
4,940,074 A * 7/1990 Menard ..... 164/412

* cited by examiner

*Primary Examiner*—M. Alexandra Elve
*Assistant Examiner*—Kevin P. Kerns

(57) ABSTRACT

A machine for forming and fitting core support pins into wax (70) surrounding a core (68) prior to covering the wax (70) with a frit (76), includes one or more punch devices (30), (82) within its structure, so as to enable the forming of one or more indentations in each pin, intermediate its ends, thereby providing a designed weakness in the pin to cause it to more reliably follow slight relative movement which occurs between the pins and the part being cast, thus reducing stresses in the surface of the part.

3 Claims, 1 Drawing Sheet

APPARATUS FOR PERFORMING FOUNDRY WORK

This application is a divisional application of Ser. No. 09/978,028 (filed Oct. 17, 2001), now abandoned.

FIELD OF THE INVENTION

It is well known in the field of foundry work, to form hollow articles of intricate shape, by first forming a dissolvable core, forming a wax mould thereabout, and then inserting pins in the wax, so that their inner ends abut the core, and their outer ends protrude from the wax. A damp ceramic frit is then applied to the wax, thus covering the outer ends of the pins. The frit is dried so as to solidify it, and provide it with sufficient strength to hold the pins firmly. The wax is then melted and allowed to run from between the core and the frit, and molten metal is poured into the resulting space.

BACKGROUND OF THE INVENTION

A machine which cuts the pins to a required length, and places them into wax covering a core, is described, illustrated and claimed in European patent 0072088, owned by the applicant for a patent for the present invention, as disclosed and claimed in this specification.

Experience gained during use of the machine, the subject of European Patent 0072088 in the production of hollow turbine blades, showed that the machine functioned perfectly, but the pins produced thereby generated unacceptable local stress loads into the surface of the casting. During solidifying of the metal, small, unavoidable relative movement occurs between the casting and the hardened frit, at a time insufficient for the pins to have been melted and absorbed by the cast metal. Stress in the form of tension was thus created in the blade surface at each place of contact with a pin, which required a dressing operation to remove it, some blades being scrapped as a result.

SUMMARY OF THE INVENTION

A first aspect of the present invention seeks to provide an improved core locating pin. Accordingly, a core locating pin which in operation spaces a core from a surrounding ceramic frit, by having one end buried in said frit, and the other end abutting said core, comprises a rod which includes an indentation intermediate its ends, said indentation being so positioned therein as to lie entirely within said frit, with one edge coinciding with the interior face thereof.

A further aspect of the present invention seeks to provide an improved core locating pin forming and fitting machine. Accordingly, a core locating pin forming and fitting machine comprises a cylindrical body containing a pressure actuated piston and rod, said rod having a first bore diametrically therethrough at a position adjacent its free end, which bore, in one position of said rod, and via a bore in the cylinder wall, receives pin wire from an external source, said rod having a second bore normal thereto and connecting said first bore with a space between the rod end and the end wall of the cylindrical body, which space contains a punch device which in operation passes through said second bore, and punches an indentation in pin wire when it is loaded into said first bore, prior to said pin wire, when in said first bore, being cut to form a pin of a desired length by movement of said piston and rod relative to said cylindrical body, to a position wherein said first bore is aligned with a further, pin ejection bore in the wall of the cylindrical body.

BRIEF DESCRIPTION OF THE DRAWINGS

The invention will now be described, by way of example and with reference to the accompanying drawings, in which.

DETAILED DESCRIPTION OF THE INVENTION

Figure 1:
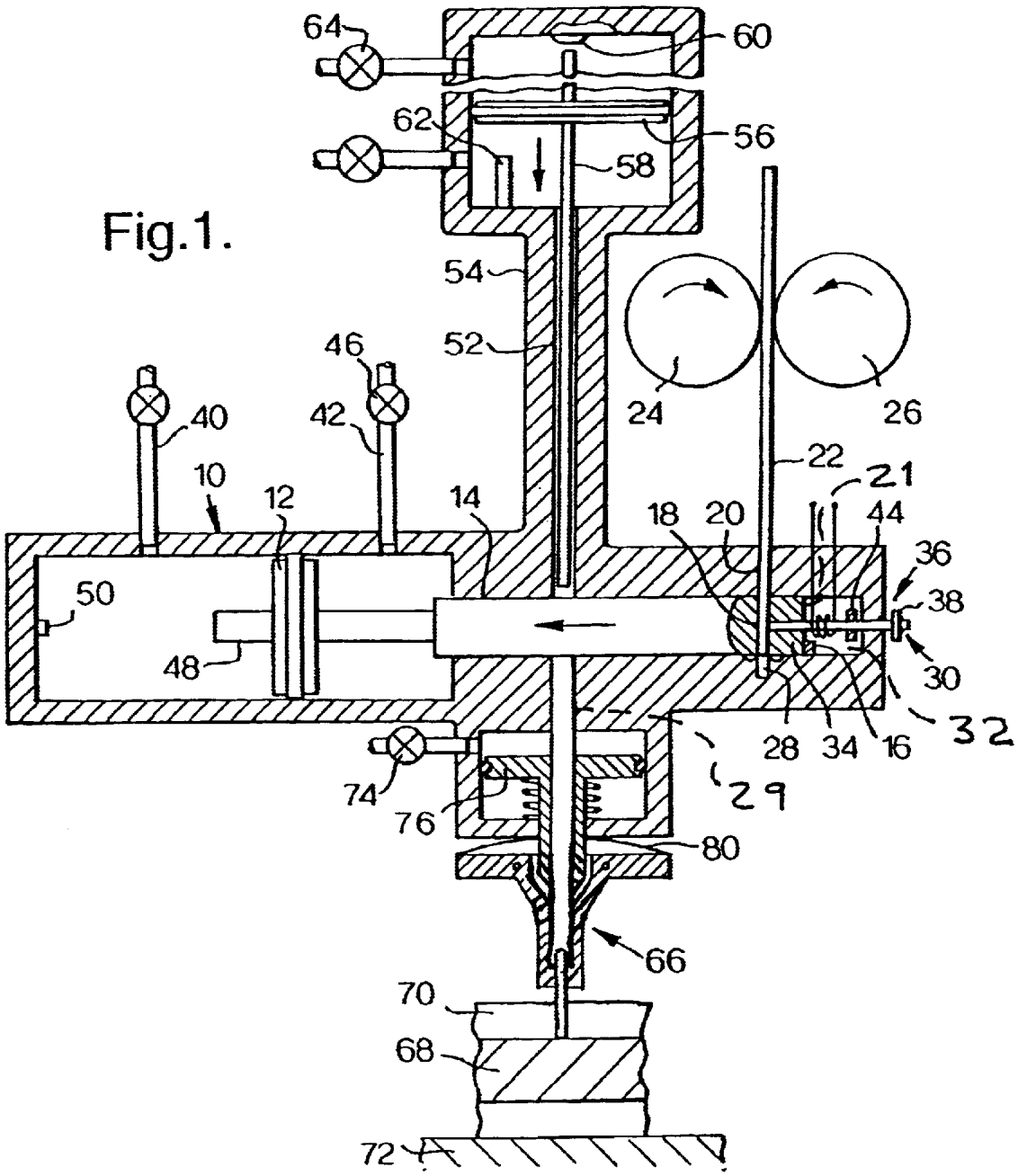
FIG. 1. is a diagrammatic, axial cross sectional view through a core locating pin forming and fitting machine, in accordance with the present invention.

Referring to FIG. 1. cylindrical body 10 contains a piston 12 and an associated rod 14, which extends to the right of piston 12, as viewed in the drawing. In a "ready to operate" situation, the end extremity of rod 14 abuts a stop 16, so that a bore 18 which is provided diametrically through rod 14 at a position near its free end, is aligned with a bore 20 through the wall of cylindrical body 10. By this means, pin wire 22 can be pulled from an external supply (not shown) by pinch rollers 24, 26, and passed through bores 18 and 20, until its end abuts a stop 28 in the wall of the cylindrical body 10.

The right-hand end extremity of cylindrical body 10 as viewed in the drawing, supports a solenoid actuated punch 30, the operative part of which lies within a space 32 defined by the end 21 of rod 14, and the inner end portion of cylindrical body 10. When a microprocessor (not shown) is switched on, stop 16, which rod 14 abuts, sends an electronic signal via said microprocessor (not shown) to the pinch drums 24 and 26, causing them to rotate and push pin wire 22,via bores 20 and 18, onto stop 28. A signal is generated by stop 28, which via the microprocessor (not shown), cancels the wire pushing signal, but actuates the solenoid and thus causes the punch 30 to thrust through a bore 34 in the end extremity of rod 14, (and, in the present example, co-axial with rod 14.) and strike the side of the pin wire so as to create an indentation therein. The depth of the indentation will be decided by design, and the length of the punch 30 accordingly proportioned. Thus, when the striking end of punch 30 is just touching the pin wire 22, the space 36 between the outer end face of cylindrical body 10 and a stop collar 38 fixed to the outer end of punch 30, will correspond to the required depth of the indentation.

Conduits 40 and 42 are connected to the cylindrical body 10, so as to straddle piston 12, and enable pressurized air from a source (not shown) to be supplied as required, to either side of piston 12. Thus, loading and punching of the pin wire having been achieved as described in the immediately preceding paragraph, punch 30 is withdrawn from the pin wire, in the present example by the action of a diaphragm spring 44, air is pumped via valve 46 to the right-hand side of piston 12, to move it and its rod 14 to the left as viewed in the drawing, until an extension 48 of rod 14 abuts a stop 50, which causes a signal to pass via the microprocessor (not shown) to close valve 46.

Movement of rod 14 as described hereinbefore, shears a pin from pin wire 22 and carries it to a point where rod extension 48 contacts the stop 50, which ensures that bore 18 is in axial alignment with a bore 52 in a further cylindrical body 54, which is integral with, and axially normal to, cylindrical body 10. A further piston 56 and associated rod 58 lie within body 54 and, in a "ready to operate" position as shown in the drawing, 56 lies midway between two stops 60 and 62, thus holding the lower end extremity of rod 58, which lies in bore 52, in spaced relationship with rod 14. However, contact of rod extension 48 with stop 50, signals via the microprocessor (not shown) the opening of a valve 64, which passes pressurized air to piston 56 to move it and thus cause associated piston 58 to push the pin out of bore 18 and through the lower part 29 of bore 52, and into and partly through a collet device 66, 50 as to protrude therefrom. The correct length of stroke of piston 56 is determined by the stop 62, which piston 56 abuts when the desired pin protrusion has been achieved.

Abutment of piston 56 on stop 62 causes output of a signal from the microprocessor (not shown) which drives the machine along slides (not shown) towards a wax covered core 68, which is located in a jig 72, so as to push the pin through the wax 70, until it abuts the core 68. The abutting action outputs a further signal from the microprocessor, which opens a valve 74, to allow pressurized air to a piston 76 within body to move its associated rod 58 into the interior of the collet device 66 and force it open, against the collet closing pressure exerted by a bellville washer 80, so as to release the pin. The opening action of collet device 66 causes output of another signal from the microprocessor (not shown) which brings about withdrawal of the machine, to the position in which the process is re-started.

It is preferred that the indentation is positioned in the pin wire, such that when the completed pin is positioned in the wax as described hereinbefore, the indentation is entirely outside the wax, so that the frit, when applied, covers it. However, it is also preferred that one edge of the indentation should be against the outer surface of the wax. This means that the thickness of the wax through which the pin is to penetrate, must decide the position of punch 30 in body 10, relative to the end of the pin wire that abuts stop 28, and in use, abuts core 68. It follows, that if a pin is required, in which the indentation is offset from the mid point of the overall length thereof, the punch must be correspondingly offset from the axis of rod 14.

Figure 2:
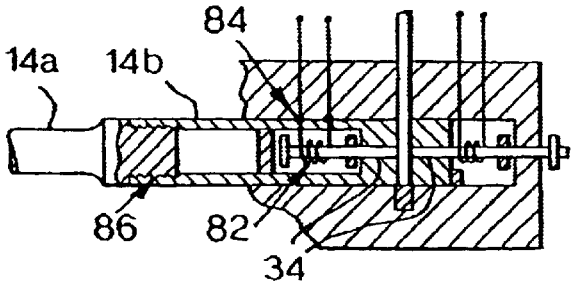
FIG. 2. is a cross sectional part view of the machine of FIG. 1. but including an alternative forming arrangement.

Referring now to FIG. 2, rod 14 is made in two parts, 14*a* and 14*b*. Part 14*b* is bored out to a depth equi-distant from bore 18 as is the end extremity of rod 14, and bore 34 is extended thereto. A second solenoid operated punch mechanism 82 is provided in the bore in rod part 14*b* in opposition to punch mechanism 30, so as to enable simultaneous punching of opposing sides of the pin wire 22, should this be desirable. After fitting the second punch mechanism 82, parts 14*a* and 14*b* of rod 14 can be joined by appropriate male and female screw threads 86.

On movement of rod 14 to achieve shearing of a pin, the solenoid circuit of punch 82 will be broken. Therefore sliding contacts 84 are provided so as to enable disconnection and reconnection of the circuit, as rod 14 is reciprocated. The solenoid actuation may be substituted by pneumatic or other suitable punch actuating means.

I claim:

1. A core locating pin forming and fitting machine comprising a cylindrical body 10 having an end wall 36 and a bore 20 extending in a diametrical direction and containing a pressure actuated piston 12 and rod 14 having a free end 21, said cylindrical body having a pin ejection opening 29 said rod 14 having a first bore 18 diametrically therethrough at a position adjacent said free end which said first bore 18 adjacent said free end 21, in one position of said rod 14 and via said bore 20 in the cylindrical body, receives pin wire 22 from an external source, said rod 14 having a second bore 34 extending from said free end 21 of said rod 14 and arranged normally thereto, said second bore connecting said first bore 18 with a space 32 between the rod free end 21 and the end wall of the cylindrical body, which space 32 contains a punch device 30 which in operation passes through said second bore 34, to punch an indentation in said pin wire, when said pin wire is loaded into said first bore 18, prior to said pin wire, when in said first bore 18 being cut to form a pin of selected length, said piston 12 and rod 14 being movable relative to said cylindrical body, to a position wherein said first bore 18 is aligned with said pin ejection opening 29 in the cylindrical body, said second bore 34 of said rod 14 being positioned to locate the indentation formed in said pin wire at a selected position along the selected length of the resulting pin whereby, when the pin is inserted into a layer of wax on a core, the indentation will be disposed externally to the layer of wax.

2. A core locating pin forming and fitting machine as claimed in claim 1, wherein said rod 14 is constructed from two attachable parts 14*a* and 14*b*, one of said parts 14*b* of said rod being axially bored to a selected depth on the same axis as said second bore in said rod to form another bore in said one of said parts, said another bore of said selected depth having an end wall and a further bore extending from said end wall toward said second bore 34 of said rod and a further punch device 82 is fitted in said another bore of said selected depth of said one of said parts 14*b* of said rod so as to enable the simultaneous forming of opposing indentations in pin wire when loaded in said first bore 18 of said rod.

3. A core locating pin forming and fitting machine as claimed in claim 1 wherein said punch device comprises a solenoid actuated rod.

* * * * *